US006726155B1

(12) United States Patent
Zimmerman

(10) Patent No.: US 6,726,155 B1
(45) Date of Patent: Apr. 27, 2004

(54) GUTTER HANGING BRACKET DEVICE WITH INTEGRAL FASTENER RETAINING GUIDE STRUCTURE

(76) Inventor: Raymond G. Zimmerman, 2500 Division Hwy., Ephrata, PA (US) 17522-9310

( * ) Notice: Subject to any disclaimer, the term of this patent is extended or adjusted under 35 U.S.C. 154(b) by 0 days.

(21) Appl. No.: 09/452,491

(22) Filed: Dec. 1, 1999

(51) Int. Cl.[7] ..... E04D 13/064
(52) U.S. Cl. ..... 248/48.1; 52/12
(58) Field of Search ..... 248/48.1, 48.2; 52/11, 12

(56) References Cited

U.S. PATENT DOCUMENTS

| | | | | | |
|---|---|---|---|---|---|
| 239,880 | A | * | 4/1881 | Stricker | 248/48.1 |
| 2,144,224 | A | * | 1/1939 | Niesworth | 248/48.1 |
| 3,053,491 | A | | 9/1962 | Ramsek | 248/48.2 |
| 3,295,803 | A | * | 1/1967 | Blayden | 248/48.2 |
| 3,333,803 | A | | 8/1967 | Landis | 248/48.2 |
| 3,416,760 | A | | 12/1968 | Sauder | 248/48.2 |
| 3,737,127 | A | | 6/1973 | Maloney, Jr. et al. | 248/48.2 |
| 3,915,418 | A | * | 10/1975 | D'Amato | 248/48.2 |
| 4,169,570 | A | | 10/1979 | Morin | 248/48.2 |
| 4,210,301 | A | | 7/1980 | Weiss | 248/48.2 |
| 4,241,548 | A | | 12/1980 | Rowe | 52/11 |
| 4,294,422 | A | | 10/1981 | Odekirk | 248/48.2 |
| 4,314,683 | A | * | 2/1982 | Cunning | 248/48.2 |
| 4,345,731 | A | | 8/1982 | Rowe | 248/48.2 |
| 5,004,191 | A | | 4/1991 | Corry | 248/48.2 |
| 5,098,223 | A | * | 3/1992 | Schoenherr et al. | 248/48.1 |
| 5,271,192 | A | | 12/1993 | Nothum, Sr. et al. | 52/12 |
| 5,845,435 | A | * | 12/1998 | Knudson | 248/48.1 |
| 6,168,125 | B1 | * | 1/2001 | Winger et al. | 248/48.2 |
| 6,568,132 | B1 | * | 5/2003 | Walters | 52/12 |

* cited by examiner

*Primary Examiner*—Leslie A. Braun
*Assistant Examiner*—A. Joseph Wujciak, III
(74) *Attorney, Agent, or Firm*—Michael R. Swartz

(57) ABSTRACT

A gutter hanging bracket device includes an elongated body portion adapted to span an open top of a gutter between front and rear sides thereof, a forward attachment portion merging from a front end of the body portion for engaging the front side of the gutter, a rearward attachment portion merging from a rear end of the body portion and adapted to cooperate with a fastener for securing the rear side of the gutter to an adjacent external structure so as to hang the gutter in a cantilevered fashion adjacent to the external structure, and a fastener retaining guide structure integrally formed in a rearward section of the body portion extending between a middle section and rear end thereof. The fastener retaining guide structure includes a longitudinally extending forward rib, a longitudinally extending rearward rib disposed adjacent to the rearward attachment portion and spaced from and aligned longitudinally with the forward rib, and a longitudinally extending intermediate rib disposed between the forward and rearward ribs and aligned longitudinally therewith. The forward and rearward ribs have arcuate-shaped transverse sectional configurations bowing upwardly from the body portion while the intermediate rib has an arcuate-shaped transverse sectional configuration bowing downwardly from the body portion such that a guide channel is defined for receiving a fastener therethrough below the forward and rearward ribs and above the intermediate rib to position the fastener for securing the device to the rear side of the gutter and adjacent external structure. The body portion is bent upwardly at its middle section so as to form an obtuse angle between the front and rear ends thereof.

19 Claims, 3 Drawing Sheets

GUTTER HANGING BRACKET DEVICE WITH INTEGRAL FASTENER RETAINING GUIDE STRUCTURE

BACKGROUND OF THE INVENTION

1. Field of the Invention

The present invention generally relates to devices for hanging gutters and, more particularly, is concerned with a gutter hanging bracket device with an integral fastener retaining guide structure.

2. Description of the Prior Art

A building, such as a residential house, may have one or more gutters disposed along the lower edge of a roof thereof. The gutters are typically attached to an upper portion or facia board of an exterior wall of the building by suitable means just below the lower edge of the roof. One attachment means, known as a nail/ferrule attachment, has been used for many years to hang gutters. The nail/ferrule attachment is considered one of the strongest types of gutter hanging devices. A problem exists, however, with the nail/ferrule attachment in that it requires more labor and, particularly, more skilled labor than other types of attachment means because the nails must be driven accurately otherwise the gutter can be dented which would require its replacement.

In more recent years, attachment means known as "hidden" hangers have been used to hang gutters. A hidden hanger is generally attached to a fascia board by one or more fasteners, such as screws, which may be installed by a portable drill or automatic screw gun. The hidden hanger minimizes the amount of labor required to hang the gutter, though the hidden hanger is typically not as strong as the conventional nail/ferrule attachment. A variety of hidden gutter hanger devices have been developed over the years.

Representative examples of prior art gutter hanger devices and the like are disclosed in U.S. Pat. No. 3,053,491 to Ramser, U.S. Pat. No. 3,295,803 to Blayden, U.S. Pat. No. 3,333,803 to Landis, U.S. Pat. No. 3,416,760 to Sauder, U.S. Pat. No. 3,737,127 to Maloney, Jr. et al., U.S. Pat. No. 4,169,570 to Morin, U.S. Pat. No. 4,210,301 to Weiss, U.S. Pat. No. 4,241,548 to Rowe, U.S. Pat. No. 4,294,422 to Odekirk, U.S. Pat. No. 4,345,731 to Rowe, U.S. Pat. No. 5,004,191 to Corry and U.S. Pat. No. 5,271,192 to Nothum, Sr. et al. The Odekirk device, particularly, is a one-piece gutter hanger bracket having a nail guide portion located in a mid-section thereof. The Morin device is a multi-piece gutter hanger bracket having an open ended tubular section which holds a nail at a suitable angle for driving into the building exterior wall. While the designs of these and other prior art hanger bracket devices may be satisfactory in use for the specific purposes for which they were designed, they do not appear to have a construction which provides an optimum degree of strength nor suitable means for securely retaining a fastener in the desired position for applying to the building wall.

Consequently, a need remains for a device which provides a solution to the aforementioned prior art problems without introducing any new problems in place thereof.

SUMMARY OF THE INVENTION

The present invention provides a gutter hanging bracket device designed to satisfy the aforementioned need. The gutter hanging bracket device of the present invention has an elongated body portion with an integral fastener retaining guide structure for reliably holding a fastener in position for application to the building wall. The integral fastener retaining guide structure also increases the structural rigidity and strength of the gutter hanging bracket device over that of the prior art. The body portion of the device also is bent at a middle section between front and rear sections thereof. The front section of the body portion has a central longitudinal channel construction that further bolsters or augments the structural rigidity and strength of the device over that of the prior art so that the device does not bend significantly under normal conditions. The rear section of the body portion incorporates the integral fastener retaining guide structure. The gutter hanging bracket device is as strong as conventional nail/ferrule attachments but can be fastened with a minimum amount of labor and, particularly, with less skilled labor, without fear of damage to the gutter.

Accordingly, the present invention is directed to a gutter hanging bracket device which comprises: (a) an elongated body portion adapted to span an open top of a gutter between front and rear sides of the gutter, the body portion having opposite front and rear ends; (b) a forward attachment portion merging from the front end of the body portion and adapted to engage with the front side of the gutter; (c) a rearward attachment portion merging from the rear end of the body portion and adapted to cooperate with a fastener for securing the rear side of the gutter to an adjacent external structure so as to support the body portion in a cantilevered fashion from the external structure and thereby hang the gutter adjacent to the external structure; and (d) a fastener retaining guide structure integrally formed in the body portion, the fastener retaining guide structure including a longitudinally extending forward rib, a longitudinally extending rearward rib disposed adjacent to the rearward attachment portion and spaced from and aligned longitudinally with the forward rib, and a longitudinally extending intermediate rib disposed between the forward and rearward ribs and longitudinally aligned therewith, each of the forward and rearward ribs having an arcuate-shaped transverse sectional configuration in bowing upwardly from the body portion and the intermediate rib having an arcuate-shaped transverse sectional configuration bowing downwardly from the body portion such that a guide channel is defined by the forward, rearward and intermediate ribs for receiving the fastener therethrough below the forward and rearward ribs and above the intermediate rib to position the fastener for securing the device to the rear side of the gutter and the adjacent external structure. The device also comprises the fastener disposed through the guide channel of the fastener retaining guide structure of the body portion. The rearward attachment portion has a hole aligned with the guide channel of the fastener retaining guide structure which receives therethrough a leading end of the fastener.

The present invention also is directed to a gutter hanging bracket device which comprises: (a) an elongated body portion adapted to span an open top of a gutter between front and rear sides of the gutter, the body portion having opposite front and rear ends and a middle section spaced from the front and rear ends where the body portion is bent upward so as to form an obtuse angle extending between the front and rear ends; (b) a forward attachment portion merging from the front end of the body portion and adapted to engage with the front side of the gutter; (c) a rearward attachment portion merging from the rear end of the body portion and adapted to cooperate with a fastener for securing the rear side of the gutter to an adjacent external structure so as to support the body portion in a cantilevered fashion from the external structure and thereby hang the gutter adjacent to the external structure; and (d) a fastener retaining guide structure in the body portion between the rear end and middle section thereof defining a guide channel for receiving the fastener therethrough to position the fastener for securing the device to the rear side of the gutter and the adjacent external structure.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
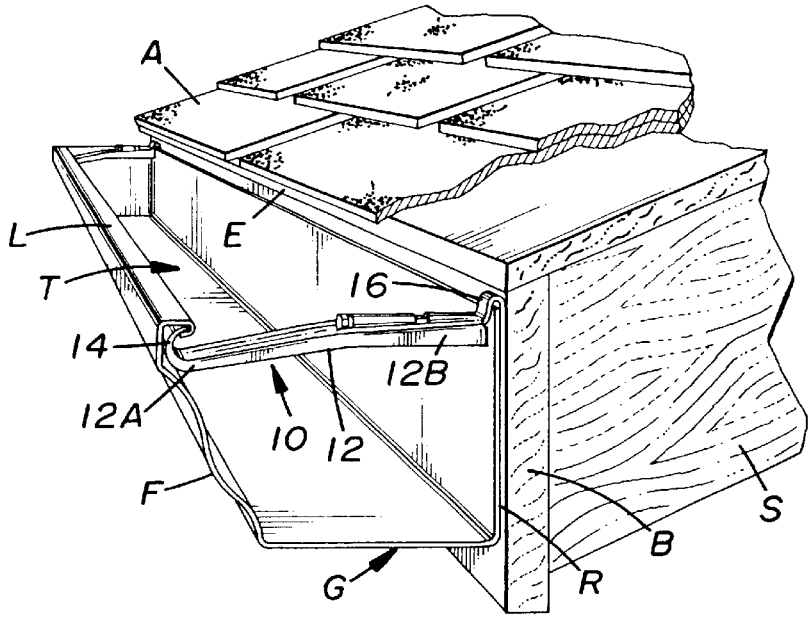
FIG. 1 is a perspective view of a gutter hanging bracket device of the present invention shown hanging a gutter to an adjacent external structure adjacent to an edge of a roof.
Figure 2:
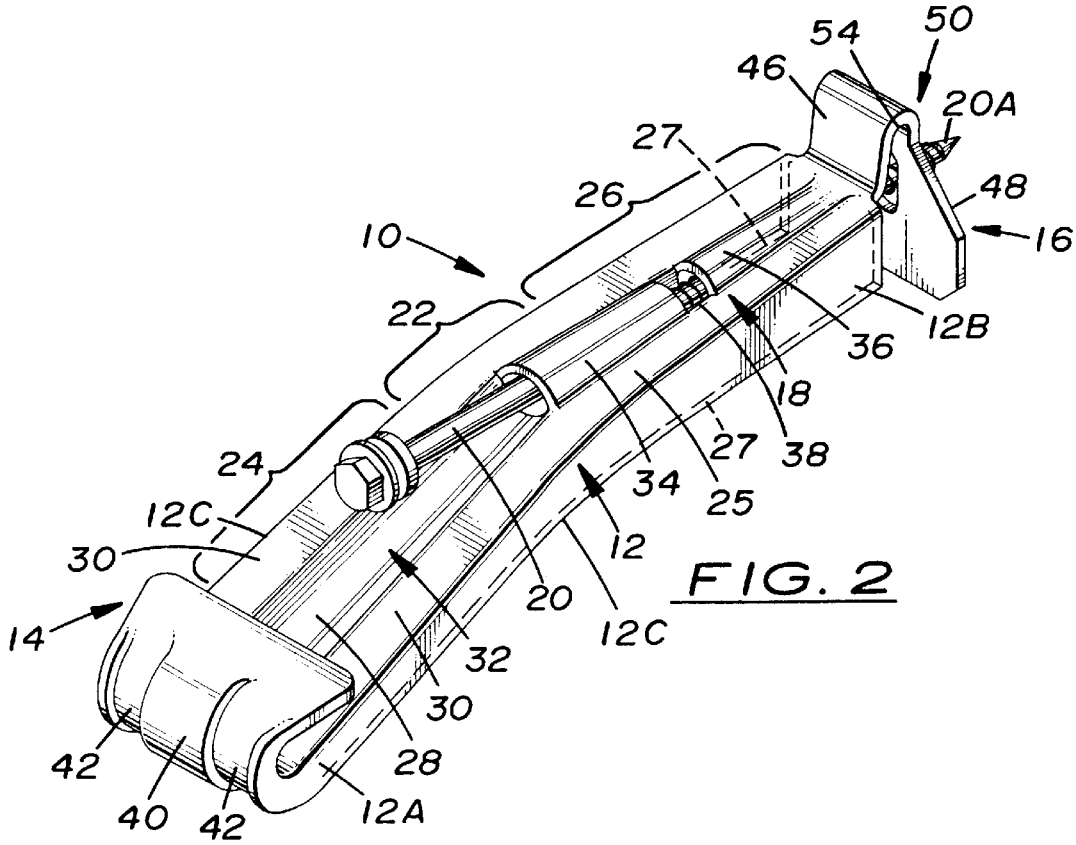
FIG. 2 is an enlarged perspective view of the gutter hanging bracket device of FIG. 1 showing a fastener retaining guide structure integrally formed in an elongated body portion of the device and a fastener of the device retained therein.
Figure 3:
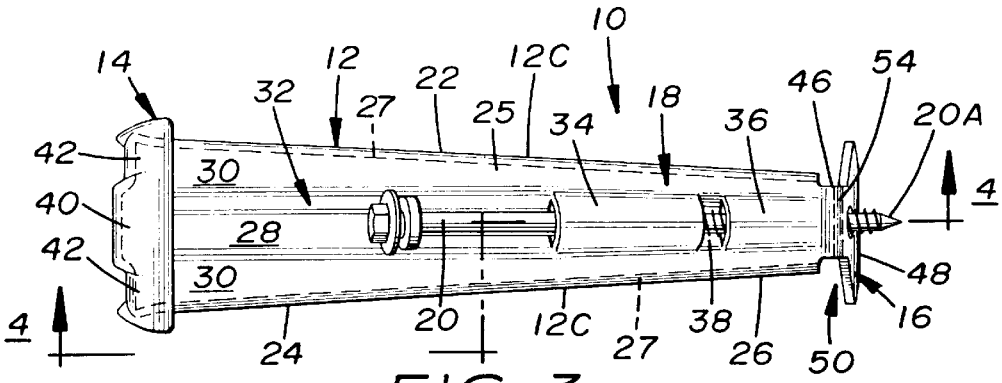
FIG. 3 is a top plan view of the device of FIG. 2.
Figure 4:
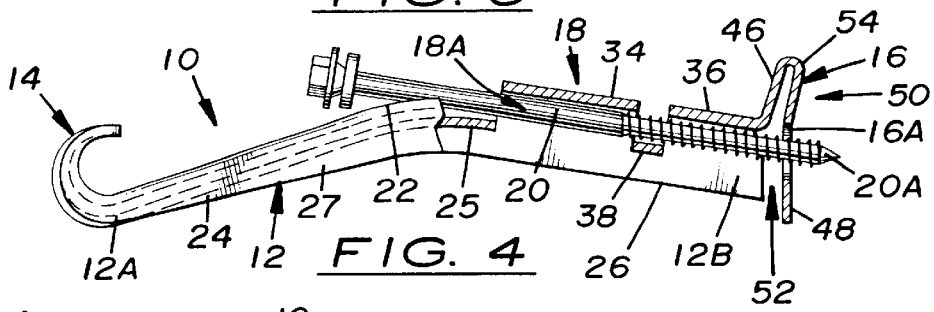
FIG. 4 is a side elevational and partially longitudinal sectional view of the device taken along line 4—4 of FIG. 3.
Figure 5:
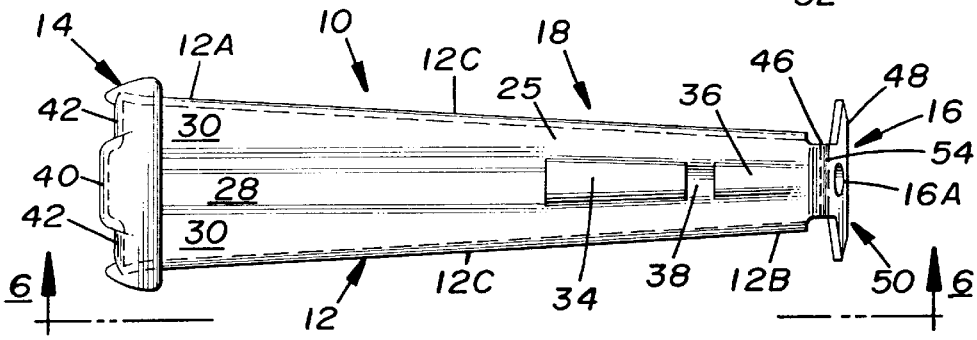
FIG. 5 is a top plan view of the device similar to FIG. 2 but without the fastener.
Figure 6:
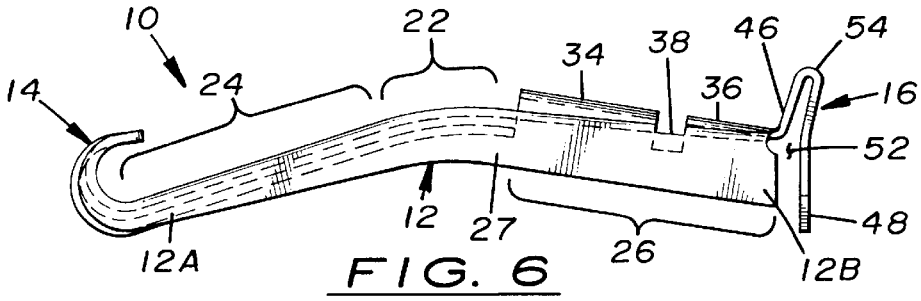
FIG. 6 is a side elevational view of the device as seen along line 6—6 of FIG. 5.
Figure 7:
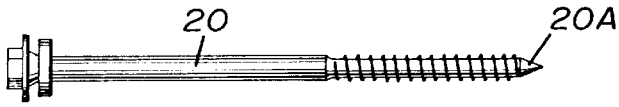
FIG. 7 is a side elevational view of the fastener of the device removed therefrom.
Figure 8:
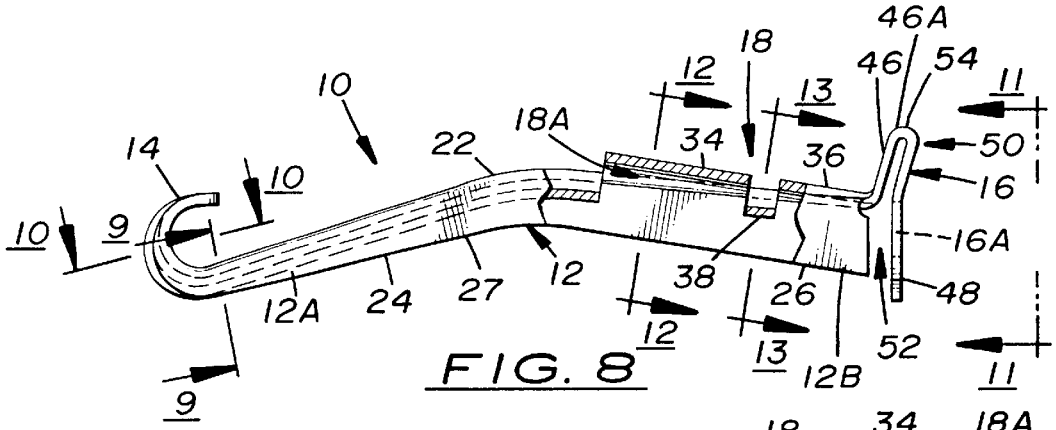
FIG. 8 is a side elevational and partially longitudinal sectional view of the device similar to FIG. 4 but without the fastener.
Figure 9:
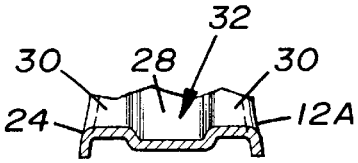
FIG. 9 is a cross-sectional view of the device taken along line 9—9 of FIG. 8 through a forward attachment portion of the device.
Figure 10:
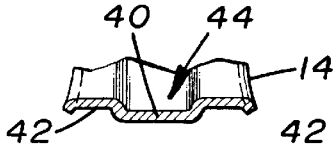
FIG. 10 is a cross-sectional view of the device taken along line 10—10 of FIG. 8 through a forward end of the body portion of the device adjacent to the forward attachment portion thereof.
Figure 12:
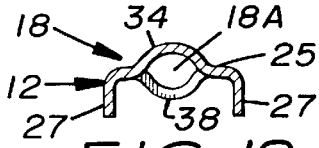
FIG. 12 is a cross-sectional view of the device taken along line 12—12 of FIG. 8 through a forward longitudinal rib of the fastener retaining guide structure of the device.
Figure 11:
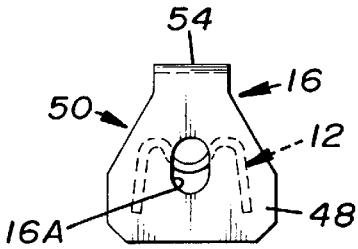
FIG. 11 is an end elevational view of a rearward attachment portion of the device as seen along line 11—11 of FIG. 8.
Figure 13:
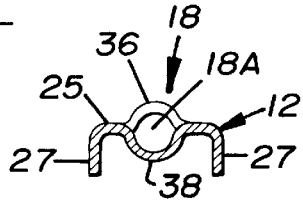
FIG. 13 is a cross-sectional view of the device taken along line 13—13 of FIG. 8 through an intermediate longitudinal rib of the fastener retaining guide structure of the device.

In the following description, like reference characters designate like or corresponding parts throughout the several views of the drawings. Also in the following description, it is to be understood that such terms as "forward", "rearward", "upwardly", "downwardly", and the like are meant to be words of convenience and are not to be construed as limiting terms.

Figure 14:
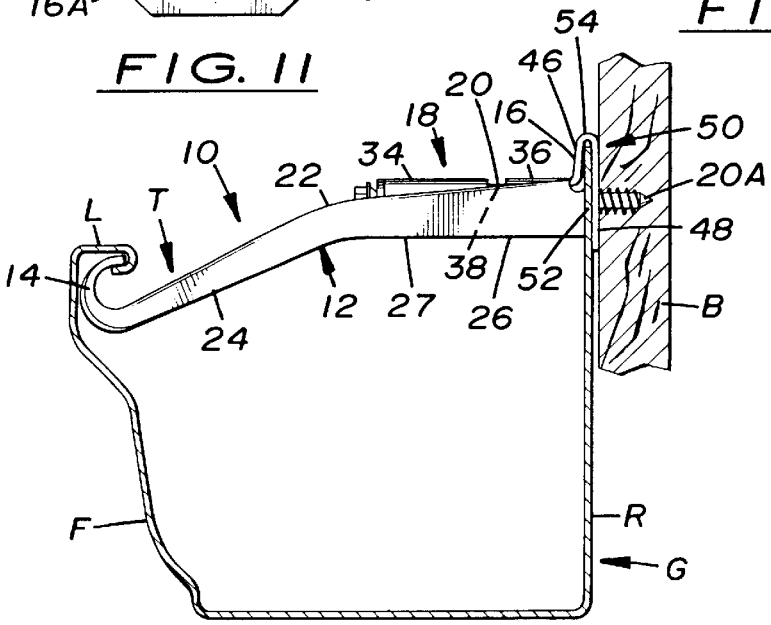
FIG. 14 is an enlarged side elevational view of the device of FIG. 1 shown hanging the gutter to the adjacent external structure.

Referring to the drawings and particularly to FIGS. 1 and 14, there is illustrated a gutter hanging bracket device, generally designated 10, of the present invention, used to hang a gutter G below an edge E of a roof A and to a fascia board B of an external structure, such as a building S. The gutter hanging bracket device 10 basically includes an elongated body portion 12, a forward attachment portion 14, a rearward attachment portion 16 and a fastener retaining guide structure 18. The body portion 12 is adapted to span an open top T of the gutter G between front and rear sides F, R thereof. The body portion 12 includes opposite front and rear ends 12A, 12B and a opposite sides 12C which converge toward one another in a direction extending from the front end 12A to the rear end 12B. The forward attachment portion 14 is integrally attached to and merges from the front end 12A of the body portion 12 and is adapted to engage with the front side F of the gutter G. The rearward attachment portion 16 is integrally attached to and merges from the rear end 12B of the body portion 12. The gutter hanging bracket device 10 also may include an elongated fastener 20, such as a lag screw shown in FIGS. 2 to 4, 7 and 12, disposed through a guide channel 18A defined by the fastener retaining guide structure 18 of the body portion 12. The rearward attachment portion 16 has a hole 16A aligned with the guide channel 18A of the fastener retaining guide structure 18 which receives therethrough a leading end 20A of the fastener 20 supported by the guide structure 18 in a position ready for screwing into the external structure S. Thus, the rearward attachment portion 16 and the fastener 20 of the device 10 are positioned to cooperate together for attaching the rear side R of the gutter G to the adjacent external structure, such as the fascia board B of the building S, so as to support the body portion 12 in a cantilevered fashion from the external structure S and thereby hang the gutter G adjacent thereto.

Referring now to FIGS. 1 to 6 and 8 to 14, the body portion 12 also includes a middle section 22, a front section 24 extending from the front end 12A of the body portion 12 to the middle section 22, and a rear section 26 extending from the rear end 12B of the body portion 12 to the middle section 22. The respective front and rear sections 24,26 of the body portion 12 have a generally straight configuration. The body portion 12 is bent downward at the middle section 22 so as to form an obtuse angle extending between the front and rear ends 12A, 12B of the body portion 12, providing the body portion 12 with a substantially shallow inverted V-shaped longitudinal cross-section. The body portion 12 generally includes a top wall 25 and a pair of opposite side walls 27 attached to and extending downward from opposite side edges of the top wall 25 such that the body portion 12 is provided with a generally inverted U-shaped transverse configuration.

The front section 24 of the body portion 12 has a central recessed longitudinal wall 28 and a pair of opposite side raised longitudinal walls 30 forming a central longitudinal channel 32. The central recessed wall 28 has a substantially planar transverse configuration. Each of the side raised walls 30 has a substantially inverted U-shaped configuration. The central recessed wall 28 has a transverse width which decreases from the front end 12A to the middle section 22 of the body portion 12. Each of the side raised walls 30 has a transverse width which stays substantially uniform from the front end 12A to the middle section 22 of the body portion 12. The transverse width of the central recessed wall 28 is approximately twice the transverse width of one of the side raised walls 30 at the front end 12A of the body portion 12 and progressively decreases to only slightly greater than the transverse width of one of the side raised walls 30 at the location of the middle section 22 of the body portion 12. Also, each of the side raised walls 30 has a height which decreases from the front end 12A to the middle section 22 of the body portion 12.

Referring now to FIGS. 1 to 6, 8 and 11 to 14, the fastener retaining guide structure 18 is integrally formed in the rear section 26 of the body portion 12. The guide structure 18 includes a longitudinally extending forward rib 34, a longitudinally extending rearward rib 36 disposed adjacent to the rearward attachment portion 16 and spaced from and aligned longitudinally with the forward rib 34, and a longitudinally extending intermediate rib 38 disposed between the forward and rearward ribs 34, 36 and longitudinally aligned therewith. Each of the forward and rearward ribs 34, 36 has an arcuate-shaped, particularly inverted U-shaped, transverse sectional configuration bowing upwardly from the top wall 25 of the body portion 12. The intermediate rib has an arcuate-shaped, particularly U-shaped, transverse sectional configuration bowing downwardly from the top wall 25 of the body portion 12 such that the guide channel 18A defined by the forward, rearward and intermediate ribs 34, 36, 38 receives the fastener 20 therethrough below the forward and rearward ribs 34, 36 and above the intermediate rib 38 so as to position the fastener 20 for securing the device 10 to the rear side R of the gutter G and the adjacent external structure S. Further, the forward rib 34 has a longitudinal length greater than a longitudinal length of the rearward rib 38. Each of the forward and rearward ribs 34, 36 has a longitudinal length greater than a longitudinal length of the intermediate rib 38.

Also, the forward rib 34 of the guide structure 18 relative to the top wall 25 has a first height adjacent to the middle section 22 of the body portion 12 and a second height less than the first height and remote from the middle section 22 of the body portion 12 such that the forward rib 34 tapers toward the top wall 25 of the body portion 12 in a direction extending from the middle section 22 toward the rear end 12B of the body portion 12. The rearward rib 36 of the guide structure 18 relative to the top wall 25 has a first height no greater than the second height of the forward rib 34 and a second height less than the first height of the rearward rib 36 such that the rearward rib 36 tapers toward the top wall 25 of the body portion 12 in the direction extending from the middle section 22 toward the rear end 12B of the body portion.

Referring now to FIGS. 2 to 6, 8 and 14, the forward attachment portion 14 forms an extension of the front end 12A of the body portion 12 such that the forward attachment portion 14 has the central longitudinal channel construction continuous with that of the front section 24 of the body portion 12. The forward attachment portion 14 includes a forward central recessed end wall 40 and a pair of opposite forward side raised walls 42 forming a forward central longitudinal channel 44. The forward central recessed end wall 40 and forward side raised walls 42 of the forward attachment portion 14 merge from and form extensions of the central recessed wall 20 and side raised walls 30 of the front section 24 of the body portion 12 such that the forward central longitudinal channel 44 of the forward attachment portion 14 is continuous with the central longitudinal channel 32 of the front section 24 of the body portion 12. The forward central recessed wall 40 has a substantially planar transverse configuration. Each of the forward side raised walls 42 has a substantially inverted U-shaped configuration. The forward attachment portion 14 has a generally C-shaped configuration adapted to be captured under a rearwardly extending ledge L on the front side F of the gutter G. More particularly, the forward attachment portion 14 is in the form of a hook having an arcuate configuration curving upwardly from the front end 12A of the body portion 12 and rearwardly toward the rear end 12B of the body portion 12.

Referring now to FIGS. 2 to 6, 8, 11 and 14, the rearward attachment portion 16 includes a rearward end wall 46 merging from the top wall 25 at the rear end 12B of the body portion 12 and having an upper end 46A and extending upwardly from the rear end 12B of the body portion 12, and a rear leg 48 merging from the upper end 46A of the rearward end wall 46 and spaced rearward and extending downward therefrom so as to form a clip 50 having an inverted U-shaped configuration. The clip 50 defines a slot 52 between the rear leg 48 and rearward end wall 46 and rear end 12B of the body portion 12 and being open at a bottom of the clip 50 for receiving the rear side R of the gutter G therein. The clip 50 has a top which is closed by a bight 54 which interconnects the rear leg 48 to the upper end 46A of the rearward end wall 46. The rearward end wall 46 of the clip 50 has a transverse width which is substantially uniform from the rear end 12B of the body portion 12 through the bight 54 of the clip 50 but less than the rear leg 48 thereof. The rear leg 48 of the rearward attachment portion 16 defines the hole 16A for receiving the leading end 20A of the fastener 20 therethrough to position the fastener 20 for securing the rearward attachment portion 16 and rear side R of the gutter G to the adjacent external structure S.

The gutter hanging bracket device 10 may be constructed by conventional cold forming techniques and is preferably formed from a continuous blank of sheet metal.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. A gutter hanging bracket device, comprising:

(a) an elongated body portion adapted to span an open top of a gutter between front and rear sides of the gutter, said body portion having opposite front and rear ends;

(b) a forward attachment portion merging from said front end of said body portion and adapted to engage with the front side of the gutter;

(c) a rearward attachment portion merging from said rear end of said body portion and adapted to cooperate with a fastener for securing the rear side of the gutter to an adjacent external structure so as to support said body portion in a cantilevered fashion from the external structure and thereby hang the gutter adjacent to the external structure; and (d) a fastener retaining guide structure integrally formed in said body portion, said fastener retaining guide structure including a longitudinally extending forward rib, a longitudinally extending rearward rib disposed adjacent to said rearward attachment portion and spaced from and aligned longitudinally with said forward rib, and a longitudinally extending intermediate rib disposed between said forward and rearward ribs and longitudinally aligned therewith, each of said forward and rearward ribs having an arcuate-shaped transverse sectional configuration bowing upwardly from said body portion and said intermediate rib having an arcuate-shaped transverse sectional configuration bowing downwardly from said body portion such that a guide channel is defined by said forward, rearward and intermediate ribs for receiving the fastener therethrough below said forward and rearward ribs and above said intermediate rib to position the fastener for securing said device to the rear side of the gutter and the adjacent external structure;

(e) said body portion including a front section, a middle section and a rear section, said front section extending from said front end of said body portion to said middle section thereof and having a longitudinally extending channel construction, said rear section extending from said middle section of said body portion to said rear end thereof and integrally forming said fastener retaining guide structure, said middle section being spaced between said front and rear sections and being bent downward so as to form an obtuse angle extending between said front and rear ends of said body portion, said obtuse angle being formed below said middle section of said body portion.

2. The device as recited in claim 1, wherein said forward rib has a longitudinal length greater than a longitudinal length of said rearward rib.

3. The device as recited in claim 1, wherein said forward and rearward ribs each has a longitudinal length greater than a longitudinal length of said intermediate rib.

4. The device as recited in claim 1, wherein said body portion has a pair of opposite sides which converge toward one another in a direction extending from said front end to said rear end thereof.

5. The device as recited in claim 1, wherein said forward attachment portion has a generally C-shaped configuration adapted to be captured under a rearwardly extending ledge on the front side of the gutter.

6. The device as recited in claim 1, wherein said rearward attachment portion includes:

a rearward end wall having an upper end and extending upwardly from said rear end of said body portion; and a rear leg merging from said upper end of said rearward end wall and spaced rearwardly and extending downwardly from said rearward end wall so as to form a clip having an inverted U-shaped configuration and defining a slot between said rear leg and said rearward end wall and said rear end of said body portion and being open at a bottom of said clip for receiving the rear side of the gutter therein.

7. The device as recited in claim 6, wherein said rear leg of said rearward attachment portion defines a hole for receiving an end of the fastener therethrough to position said fastener end for securing said rearward attachment portion and the rear side of the gutter to the external structure.

8. The device as recited in claim 1, further comprising:

a fastener disposed through said guide channel of said fastener retaining guide structure of said body portion.

9. The device as recited in claim 8, wherein said rearward attachment portion has a hole aligned with said guide channel of said fastener retaining guide structure and receiving therethrough a leading end of said fastener.

10. A gutter hanging bracket device, comprising:

(a) an elongated body portion adapted to span an open top of a gutter between front and rear sides of the gutter, said body portion having opposite front and rear ends;

(b) a forward attachment portion merging from said front end of said body portion and adapted to engage with the front side of the gutter;

(c) a rearward attachment portion merging from said rear end of said body portion and adapted to cooperate with a fastener for securing the rear side of the gutter to an adjacent external structure so as to support said body portion in a cantilevered fashion from the external structure and thereby hang the gutter adjacent to the external structure; and (d) a fastener retaining guide structure integrally formed in said body portion, said fastener retaining guide structure including a longitudinally extending forward rib, a longitudinally extending rearward rib disposed adjacent to said rearward attachment portion and spaced from and aligned longitudinally with said forward rib, and a longitudinally extending intermediate rib disposed between said forward and rearward ribs and longitudinally aligned therewith, each of said forward and rearward ribs having an arcuate-shaped transverse sectional configuration bowing upwardly from said body portion and said intermediate rib having an arcuate-shaped transverse sectional configuration bowing downwardly from said body portion such that a guide channel is defined by said forward, rearward and intermediate ribs for receiving the fastener therethrough below said forward and rearward ribs and above said intermediate rib to position the fastener for securing said device to the rear side of the gutter and the adjacent external structure;

(e) said body portion including a middle section spaced from said front and rear ends of said body portion; and said forward rib of said fastener retaining guide structure having a first height adjacent to said middle sections of said body portion and a second height less than said first height remote from said middle section of said body portion such that said forward rib tapers toward said body portion in a direction extending from said middle section toward said rear end of said body portion.

11. The device as recited in claim 10, wherein said rearward rib of said fastener retaining guide structure has a first height no greater than said second height of said forward rib and a second height less than said first height of said rearward rib such that said rearward rib tapers toward said body portion in said direction extending from said middle section toward said rear end of said body portion.

12. A gutter hanging bracket device, comprising:

(a) an elongated body portion adapted to span an open top of a gutter between front and rear sides of the gutter, said body portion having opposite front and rear ends and a middle section spaced from said front and rear ends where said body portion is bent downward so as to form an obtuse angle extending between said front and rear ends;

(b) a forward attachment portion merging from said front end of said body portion and adapted to engage with the front side of the gutter;

(c) a rearward attachment portion merging from said rear end of said body portion and adapted to cooperate with a fastener for securing the rear side of the gutter to an adjacent external structure so as to support said body portion in a cantilevered fashion from the external structure and thereby hang the gutter adjacent to the external structure; and (d) a fastener retaining guide structure on said body portion between said rear end and middle section thereof defining a guide channel for receiving the fastener therethrough to position the fastener for securing said device to the rear side of the gutter and the adjacent external structure;

(e) said body portion further including a front section extending from said front end of said body portion to said middle section thereof and having a longitudinally extending channel construction and a rear section extending from said middle section of said body portion to said rear end thereof and integrally forming said fastener retaining guide structure, said front and rear sections having a generally straight configuration and said obtuse angle being formed by said front and rear sections below said middle section.

13. The device as recited in claim 2, wherein said body portion has a substantially shallow inverted V-shaped longitudinal cross-section.

14. The device as recited in claim 12, wherein said body portion has a pair of opposite sides which converge toward one another in a direction extending from said front end to said rear end thereof.

15. The device as recited in claim 12, wherein said forward attachment portion has a generally C-shaped configuration adapted to be captured under a rearwardly extending ledge on the front side of the gutter.

16. The device as recited in claim 12, wherein said rearward attachment portion includes:

a rearward end wall having an upper end and extending upwardly from said rear end of said body portion; and a rear leg merging from said upper end of said rearward end wall and spaced rearwardly and extending downwardly from said rearward end wall so as to form a clip having an inverted U-shaped configuration and defining a slot between said rear leg and said rearward end wall and said rear end of said body portion and being open at a bottom of said clip for receiving the rear side of the gutter therein.

17. The device as recited in claim 16, wherein said rear leg of said rearward attachment portion defines a hole for receiving an end of the fastener therethrough to position said fastener end for securing said rearward attachment portion and the rear side of the gutter to the external structure.

18. The device as recited in claim 12, further comprising:

a fastener disposed through said guide channel of said fastener retaining guide structure of said body portion.

19. The device as recited in claim 18, wherein said rearward attachment portion has a hole aligned with said guide channel of said fastener retaining guide structure and receiving therethrough a leading end of said fastener.

* * * * *